US011932472B2

(12) United States Patent
Blin

(10) Patent No.: US 11,932,472 B2
(45) Date of Patent: Mar. 19, 2024

(54) CARTON AND BLANK THEREFOR

(71) Applicant: WestRock Packaging Systems, LLC, Atlanta, GA (US)

(72) Inventor: Patrick Blin, Châteauroux (FR)

(73) Assignee: WestRock Packaging Systems, LLC, Atlanta, GA (US)

( * ) Notice: Subject to any disclaimer, the term of this patent is extended or adjusted under 35 U.S.C. 154(b) by 534 days.

(21) Appl. No.: 16/764,243

(22) PCT Filed: Oct. 25, 2018

(86) PCT No.: PCT/US2018/057442
§ 371 (c)(1),
(2) Date: May 14, 2020

(87) PCT Pub. No.: WO2019/099160
PCT Pub. Date: May 23, 2019

(65) Prior Publication Data

US 2020/0277116 A1 Sep. 3, 2020

Related U.S. Application Data

(60) Provisional application No. 62/586,326, filed on Nov. 15, 2017.

(51) Int. Cl.
*B65D 71/32* (2006.01)

(52) U.S. Cl.
CPC .... *B65D 71/32* (2013.01); *B65D 2571/00185* (2013.01); *B65D 2571/00203* (2013.01);
(Continued)

(58) Field of Classification Search
CPC ..... B65D 71/32; B65D 2571/00716; B65D 2571/0016; B65D 2571/00185;
(Continued)

(56) References Cited

U.S. PATENT DOCUMENTS 2,867,320 A * 1/1959 Noble ..... B65D 71/20 206/154
3,081,928 A 3/1963 Chidsey, Jr. et al.
(Continued)

FOREIGN PATENT DOCUMENTS

WO WO2005/044549 A2 5/2005
WO WO2011/049947 A1 4/2011
WO WO-2011049947 A1 * 4/2011 ..... B65D 71/18

*Primary Examiner* — Christopher R Demeree
(74) *Attorney, Agent, or Firm* — Brian J. Goldberg; Rohini K. Garg

(57) ABSTRACT

Aspects of the disclosure relate to a carrier (90) for packaging a plurality of flanged articles, a blank (10) for forming the carrier. The carrier comprises a composite wall formed from two at least partially overlapping layers (12,20), including an inner layer (20) and an outer layer (12). The carrier further comprises a keel structure (70) folded into an interior of the carrier. The keel structure has an inner member (60) formed from the inner layer and an outer member (50) formed from the outer layer. The inner and outer members are hingedly connected to a respective one of the inner and outer layers along inner (61) and outer (51) fold lines respectively. The inner and outer fold lines are generally aligned in the direction of the thickness of the inner and outer layers.

19 Claims, 8 Drawing Sheets

(52) U.S. Cl.
CPC ..... *B65D 2571/00265* (2013.01); *B65D 2571/00277* (2013.01); *B65D 2571/0066* (2013.01); *B65D 2571/0087* (2013.01)

(58) Field of Classification Search
CPC ..... B65D 71/16; B65D 71/36; B65D 2571/00166; B65D 2571/00302; B65B 21/24
USPC ..... 229/117.16, 103.2, 198.2, 185; 206/140, 206/427, 434, 196, 149, 197; 493/137, 493/139
See application file for complete search history.

(56) References Cited

U.S. PATENT DOCUMENTS 3,189,215 A * 6/1965 Currie, Jr. ..... B65D 71/16 206/140
3,283,990 A 11/1966 Tolaas
3,314,590 A * 4/1967 Tolaas ..... B65D 71/32 206/149
3,330,463 A 7/1967 Wood
3,381,881 A 5/1968 Ganz et al.
3,931,926 A * 1/1976 Bensen ..... B65D 5/4279 229/198.2
4,440,340 A * 4/1984 Bakx ..... B65D 71/36 206/427
4,574,997 A 3/1986 Ikeda
4,600,140 A * 7/1986 Milliens ..... B65D 71/12 206/427
5,002,225 A * 3/1991 Bienaime ..... B65D 71/18 229/198.2
5,094,347 A * 3/1992 Schuster ..... B65D 71/16 206/434
5,107,986 A * 4/1992 Cooper ..... B65D 71/20 206/197
5,180,100 A * 1/1993 Shimizu ..... B65D 71/14 229/198.2
5,328,080 A 7/1994 Holley, Jr.
5,351,878 A * 10/1994 Cooper ..... B65D 71/16 206/427
5,390,848 A * 2/1995 Gungner ..... B65D 71/18 229/185
5,437,363 A * 8/1995 Gungner ..... B65D 71/32 206/196
8,997,986 B2 4/2015 Spivey, Sr.
9,376,250 B2 6/2016 Spivey, Sr.

* cited by examiner

CARTON AND BLANK THEREFOR

CROSS-REFERENCE TO RELATED APPLICATIONS

This application is a National Phase application of PCT Application PCT/US18/57442, filed Oct. 25, 2018, which claims the benefit of U.S. Provisional Patent Application No. 62/586,326, filed Nov. 15, 2017, which is incorporated herein by reference in its entirety.

TECHNICAL FIELD

The present invention relates to cartons and to blanks for forming the same. More specifically, but not exclusively, the invention relates to a carrier having a keel structure formed from a pair of overlapping panels.

BACKGROUND

In the field of packaging it is known to provide cartons for carrying multiple articles. Cartons are well known in the art and are useful for enabling consumers to transport, store and access a group of articles for consumption. For cost and environmental considerations, such cartons or carriers need to be formed from as little material as possible and cause as little wastage in the materials from which they are formed as possible. Further considerations are the strength of the carton and its suitability for holding and transporting large weights of articles. It is desirable that the contents of the carton are secure within the carton.

The present invention seeks to provide an improvement in the field of cartons, typically formed from paperboard or the like.

SUMMARY

A first aspect of the invention provides a carrier for packaging a plurality of articles. The carrier comprises a composite wall formed from two at least partially overlapping layers, including an inner layer and an outer layer. The carrier further comprises a keel structure folded into an interior of the carrier. The keel structure has an inner member formed from the inner layer and an outer member formed from the outer layer. The inner and outer members are hingedly connected to a respective one of the inner and outer layers along inner and outer fold lines respectively. The inner and outer fold lines are generally aligned in the direction of the thickness of the inner and outer layers. The inner and outer members are disposed in an overlapping relationship such that at least part of the free outline of the outer member provides a folding guide to the inner member. The folding guide facilitates folding of an engaging portion of the inner member when the outer member is folded inward of the carrier along the outer fold line against the inner member.

Optionally, the keel structure is disposed between two adjacent articles packaged in the carton and provides a spacer between said articles.

Optionally, the keel structure is formed in part from the inner layer of the composite wall and in part from the outer layer of the composite wall.

Optionally, the keel structure interlocks the inner and outer layers of the composite wall together.

Optionally, the keel structure is hingedly connected to the base wall and is folded into an interior of the carrier.

Optionally, the outer member comprises a first tab.

Optionally, the first tab comprises a first spine portion and a first engaging portion hingedly connected to the first spine portion.

Optionally, the first inner member comprises a second tab.

Optionally, the second tab comprises a second spine portion and a second engaging portion hingedly connected to the second spine portion.

Optionally, the first spine portion overlaps with the second spine portion to form a two-ply structure.

Optionally, the first outer member comprises an engaging edge and a recess is provided in the engaging edge proximate to the outer fold line.

Optionally, the first inner member defines at least in part an inner opening, the inner opening defining at least in part an edge of an engaging region of the inner layer.

Optionally, the edge of the engaging region is non-linear.

Optionally, the edge of the engaging region is arcuate.

Optionally, the edge of the engaging region is non-perpendicular with the outer fold line.

Optionally, the edge of the engaging region is obliquely oriented with respect to the outer fold line.

Optionally, the carrier comprises a top engaging device T for engaging each article to be packaged, each top engaging device T comprising an opening for receiving a portion of an article.

Optionally, the carrier comprises a plurality of individual, disconnected articles.

Optionally, the carrier comprises a plurality of connected articles.

Optionally, the articles comprise a flange.

Optionally, the articles are connected to each other via their respective flanges.

Optionally, the carrier comprises a plurality of panels forming walls of a tubular structure which may include a top wall, a first side wall, a composite base wall comprising the inner and outer layers, and a second side wall.

Optionally, the plurality of panels are hingedly connected to each other in a linear series.

A second aspect of the invention provides an article carrier for at least one article. The carrier comprises a composite wall formed from two at least partially overlapping layers including an inner layer and an outer layer. The carrier further comprises a spacer device folded into an interior of the carrier. The spacer device comprises an inner member formed from the inner layer and an access opening defined in the outer layer. The inner member is hingedly connected to the inner layer. The inner member is disposed in an overlapping relationship with the access opening so that the inner member is accessible through the access opening to enable the inner member to be folded inwardly of the carrier.

Optionally, the inner member partially overlaps with the access opening.

Optionally, the access opening is defined by an outer member formed from the outer layer Optionally, the inner member comprises an engaging portion foldable with respect to a hinged portion, the hinged portion being hinged to the inner layer, the engaging portion comprising an engaging edge which engages with an engaging portion of the outer layer to prevent or inhibit the inner member returning to an unfolded condition.

Optionally, the engaging portion of the outer layer is disposed in overlapping relationship with an opening in the inner layer created by folding the inner member inwardly of the carrier.

A third aspect of the invention provides a blank for forming a carrier. The blank comprises a plurality of panels for forming walls of the carrier. The plurality of panels comprises a first panel and a second panel for forming an inner layer and outer layer respectively of a composite wall of the carrier. The first and second panel are arranged to at least partially overlap. The blank further comprises a keel structure foldable into an interior of a set-up carrier. The keel structure has an inner member formed from the first panel and an outer member formed from the second panel. The inner and outer members are hingedly connected to a respective one of the first and second panels along inner and outer fold lines respectively. The inner and outer fold lines are arranged to be generally aligned in the direction of the thickness of the inner and outer layers in a set-up carrier. The inner and outer members are arranged to be disposed in an overlapping relationship such that at least part of the free outline of the outer member provides a folding guide to the inner member. The folding guide facilitates folding of an engaging portion of the inner member when the outer member is folded inward of the carrier along the outer fold line against the inner member.

A fourth aspect of the invention provides a blank for forming a carrier. The blank comprises a plurality of panels for forming walls of the carrier. The plurality of panels comprises a first panel and a second panel for forming an inner layer and outer layer respectively of a composite wall of a set-up carrier. The first and second panel are arranged to at least partially overlap. The blank further comprises a spacer device foldable into an interior of the carrier. The spacer device comprises an inner member formed from the first panel and an access opening defined in the second panel. The inner member is hingedly connected to the first panel. The inner member is arranged to be disposed in an overlapping relationship with the access opening in a set-up carrier so that the inner member is accessible through the access opening to enable the inner member to be folded inwardly of the carrier.

Within the scope of this application it is envisaged that the various aspects, embodiments, examples, features and alternatives set out in the preceding paragraphs, in the claims and/or in the following description and drawings may be taken independently or in any combination thereof. For example, features described in connection with one embodiment are applicable to all embodiments unless there is incompatibility of features.

BRIEF DESCRIPTION OF THE DRAWINGS

Embodiments of the invention will now be described with reference to the accompanying drawings, in which.

DETAILED DESCRIPTION OF EMBODIMENTS

Detailed descriptions of specific embodiments of the package, blanks and cartons are disclosed herein. It will be understood that the disclosed embodiments are merely examples of the way in which certain aspects of the invention can be implemented and do not represent an exhaustive list of all of the ways the invention may be embodied. As used herein, the word "exemplary" is used expansively to refer to embodiments that serve as illustrations, specimens, models, or patterns. Indeed, it will be understood that the packages, blanks and cartons described herein may be embodied in various and alternative forms. The Figures are not necessarily to scale and some features may be exaggerated or minimised to show details of particular components. Well-known components, materials or methods are not necessarily described in great detail in order to avoid obscuring the present disclosure. Any specific structural and functional details disclosed herein are not to be interpreted as limiting, but merely as a basis for the claims and as a representative basis for teaching one skilled in the art to variously employ the invention.

Figure 1:
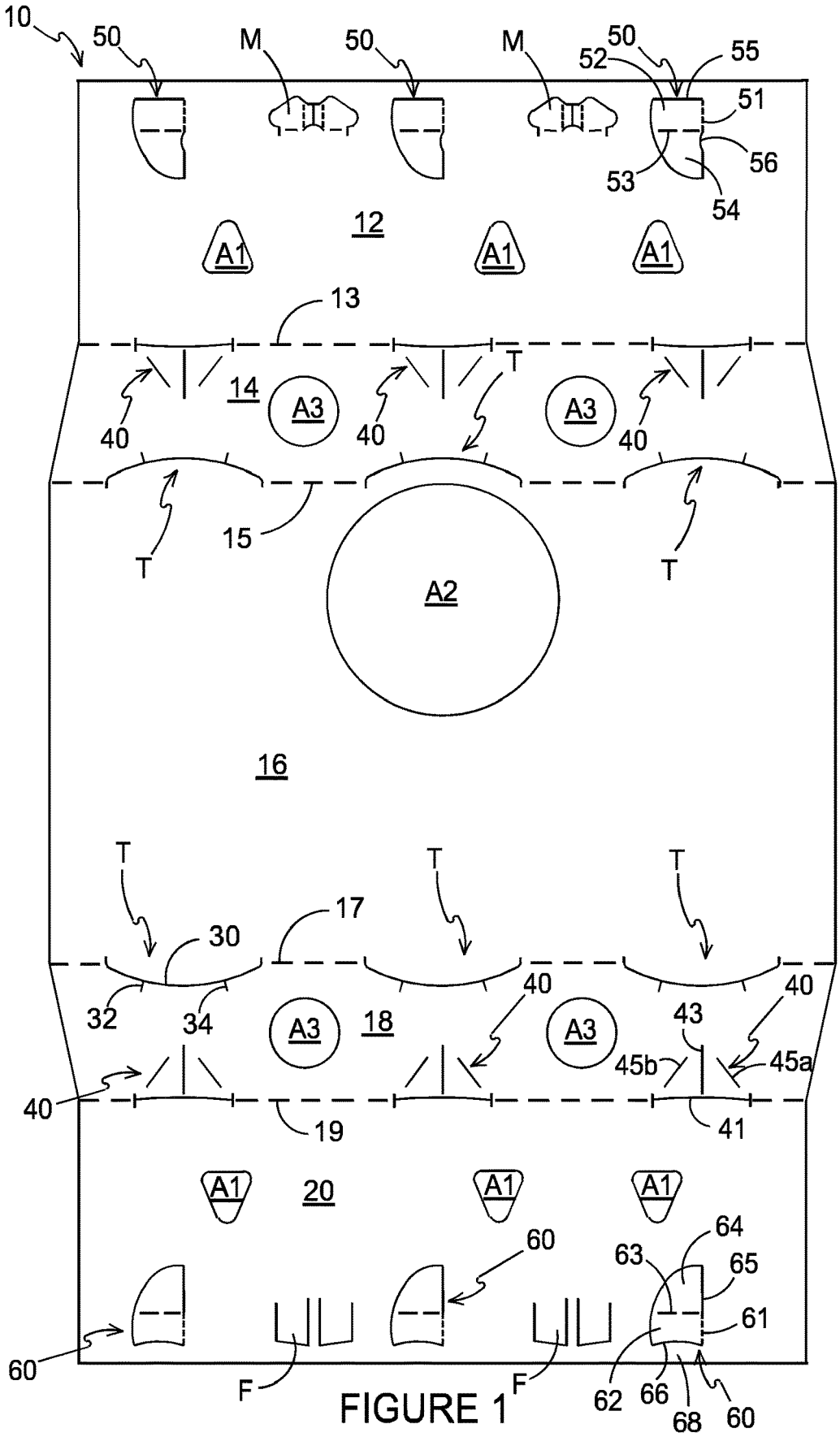
FIG. 1 is a plan view from above of a blank for forming a carton according to a first embodiment.
Figure 2:
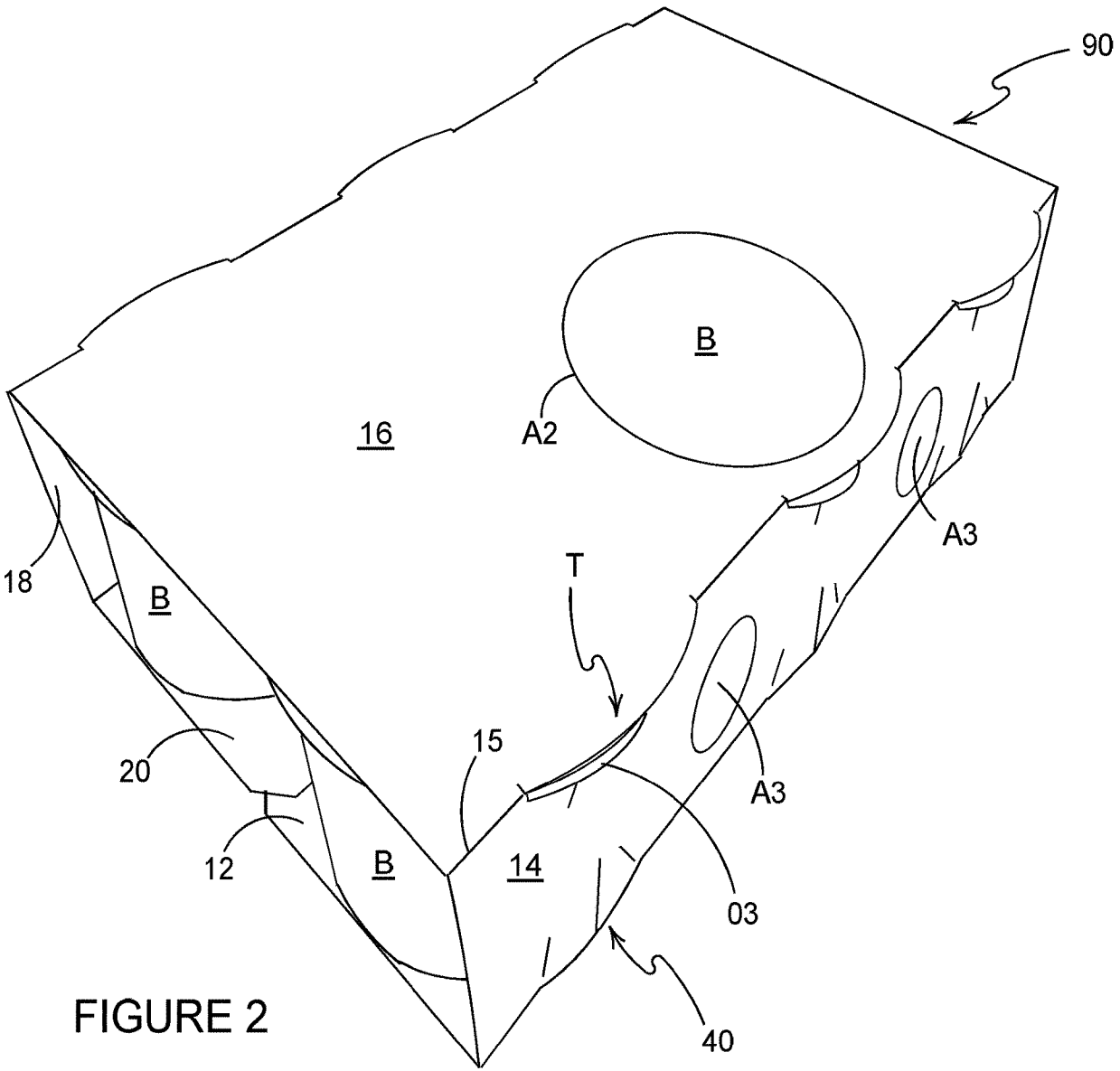
FIG. 2 is a perspective view from above of a carton formed from the blank of FIG. 1.

Referring to FIG. 1, there is shown a plan view of a blank 10 capable of forming a carton or carrier 90, as shown in FIG. 2, for containing and carrying a group of primary products such as, but not limited to, flanged containers, cups or yoghurt pots, hereinafter referred to as articles B, as shown in FIG. 2. The blank 10 forms a secondary package for packaging at least one primary product container or package.

In the embodiments detailed herein, the terms "carton" and "carrier" refer, for the non-limiting purpose of illustrating the various features of the invention, to a container 90 for engaging and carrying articles B, such as primary product containers B. It is contemplated that the teachings of the invention can be applied to various product containers B, which may or may not be tapered and/or cylindrical. Other exemplary containers include bottles (for example metallic, glass or plastics bottles), cans (for example aluminium cans), tins, pouches, packets and the like.

The blank 10 is formed from a sheet of suitable substrate. It is to be understood that, as used herein, the term "suitable substrate" includes all manner of foldable sheet material such as paperboard, corrugated board, cardboard, plastic, combinations thereof, and the like. It should be recognised that one or other numbers of blanks may be employed, where suitable, for example, to provide the carrier structure described in more detail below.

The packaging structure or carton 90 described herein may be formed from a sheet material such as paperboard, which may be made of or coated with materials to increase its strength. An example of such a sheet material is tear-resistant NATRALOCK® paperboard made by WestRock Company. It should be noted that the tear resistant materials may be provided by more than one layer, to help improve the tear-resistance of the package. Typically, one surface of the sheet material may have different characteristics to the other surface. For example, the surface of the sheet material that faces outwardly from a finished package may be particularly smooth and may have a coating such as a clay coating or other surface treatment to provide good printability. The surface of the sheet material that faces inwardly may, on the other hand, be provided with a coating, a layer, a treatment or be otherwise prepared to provide properties such as one or more of tear-resistance, good glue-ability, heat sealability, or other desired functional properties.

In the illustrated embodiment, the blank 10 is configured to form a carton or carrier 90 for packaging an exemplary arrangement of exemplary articles B. In the illustrated embodiments the arrangement is an m×n matrix or array, having two rows (m=2) and three columns (n=3); in the illustrated embodiment two rows of three articles B are provided, and the articles B are individual 170 g cups with a cover or film lid a metallic or plastic material such as, but not limited to, Aluminium or PET (polyester-polyethylene terephthalate). Alternatively, the blank 10 can be configured to form a carrier for packaging other types, number and size of articles B and/or for packaging articles B in a different arrangement or configuration for example, but not limited to, fully enclosed cartons or basket carriers, the articles B may be bottles or cans.

Turning to FIG. 1, there is illustrated a blank 10 for forming a carton 90 (see FIG. 2) according to a first embodiment. The blank 10 comprises a plurality of main panels 12, 14, 16, 18, 20 for forming a tubular structure. The plurality of main panels 12, 14, 16, 18, 20 comprises a first base panel (or outer layer) 12, a first side panel 14, a top panel 16, a second side panel 18, and a second base panel (or inner layer) 20. The plurality of panels 12, 14, 16, 18, 20, may be arranged in a linear series hinged one to the next by corresponding fold lines 13, 15, 17, 19.

The blank 10 is foldable to form a package 90 as illustrated in FIG. 2. The first and second base panels 12, 20 are engageable with one another in an overlapping relationship to form a composite base wall 12/20 of the carton 90. The blank 10 may comprise a complementary locking mechanism for securing the second base panel 20 to the first base panel 12. The first base panel 12 may comprise at least one first part F of the complementary locking mechanism. The second base panel 20 may comprise at least one second part M of the complementary locking mechanism. In the illustrated embodiment, the first base panel 12 comprises a plurality of female tabs F defining openings in the first base panel 12. The second base panel 20 comprises a plurality of male tabs M, the openings in the first base panel 12 being configured to receive a respective one of the male tabs M. Each of the female tabs F is arranged to be displaced out of the first base panel 12 to form an opening and to bear against a respective one of the male tabs M when received therein. In some embodiments the complementary locking mechanism M/F may be omitted, the first and second base panels 12, 20 may be secured to each other solely by a keel structure 70 described in detail below or by other means, such as but not limited to adhesive or staples.

Optionally, the first and second base panels 12, 20 may comprise at least one first aperture A1. In the illustrated embodiment, each of the first and second base panels 12, 20 comprises three first apertures A1. The first apertures A1 may be employed to facilitate construction of the carton 90. A packaging machine component (not shown) may engage with the first apertures A1 to enable the plurality of panels 12, 14, 16, 18, 20 to be tightened about a group of articles B. The first apertures A1 may also be employed to facilitate alignment of the first and second base panels 12, 20 with respect to each other or to align the first part of the complementary locking mechanism with the second part of the complementary locking mechanism. The complementary locking mechanism illustrated and described is entirely optional.

The blank 10 may comprise at least one heel engagement structure 40 for engaging with a heel or lower portion of an article B. The blank 10 illustrated in FIG. 1 comprises six heel engagement structures 40 each is provided for engaging a respective article B. Each of the heel engagement structures 40 is substantially similar in construction and will be described by reference to a heel engagement structure provided in the second side panel 18.

The heel engagement structure 40 may comprise a first cut line or severable line 41. The first cut line 41 interrupts the fold line 19 hingedly connecting the second side panel 18 to the second base panel 20. The first cut line 41 may be non-linear, formed from at least two linear cut lines divergently arranged with respect to each other and contiguous with each other, alternatively the first cut line 41 may be curved or arcuate in shape. A second cutline or severance line 43 extends from the first cut line 41; the second cutline or severance line 43 may extend from the middle or centre of the first cut line 41. The second cutline or severance line 43 may be arranged to be oriented substantially perpendicular to the fold line 19. The heel engagement structure 40 may comprise a pair of divergently arranged cut lines 45*a*, 45*b*. The cut lines 45*a*, 45*b* are arranged to diverge toward the first cut line 41. In this way the cut lines 41, 43, 45*a*, 45*b* define a pair of tabs, displaceable or foldable with respect to the second side panel 18. It will be appreciated that cut lines 45*a*, 45*b* may be replaced with fold or score lines to provide a hinged connection between each tab and the second side panel 18. Each of the pair of tabs may be substantially triangular in shape.

The blank 10 is adapted to accommodate six articles B arranged in a 2×3 matrix or array. The blank 10 comprises six top engaging structures T. Each of the top engaging structures T is substantially similar in construction and will be described with reference to a top engaging structure T provided in the second side panel 18.

Figure 5:
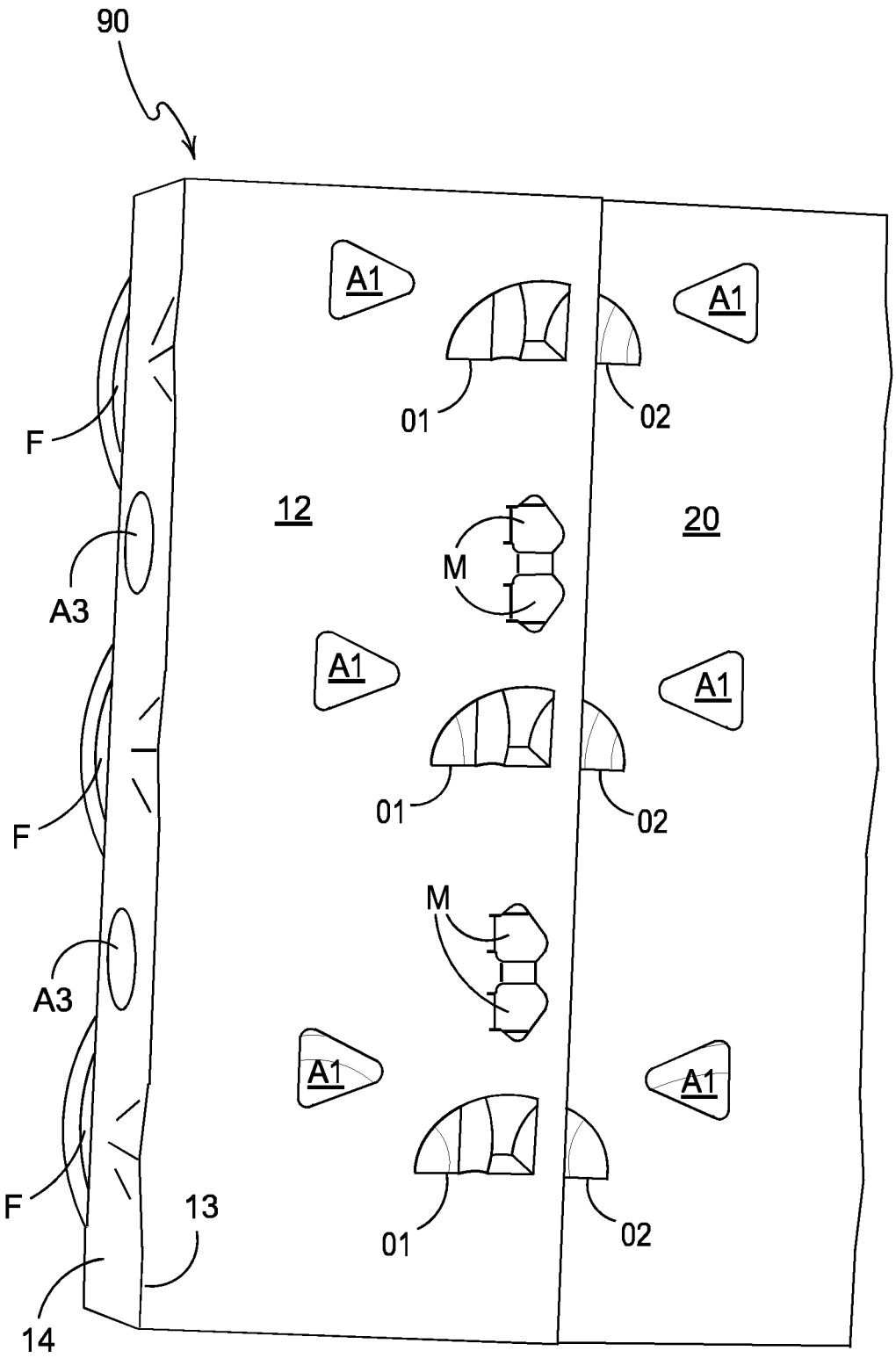
FIG. 5 is a perspective view from below of the carton of FIG. 2.
Figure 6A:
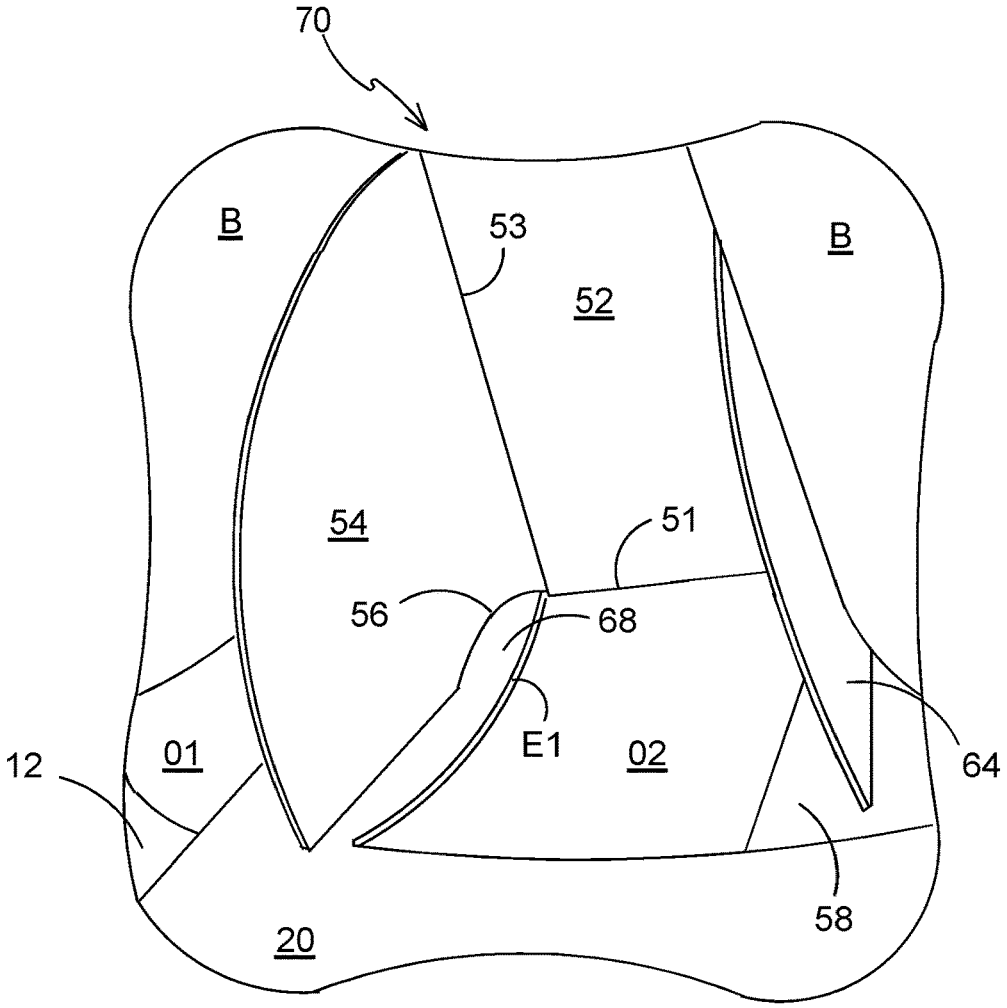
FIGS. 6A and 6B are perspective views of a keel structure erected in an interior of the carton of FIG. 2.
Figure 6B:
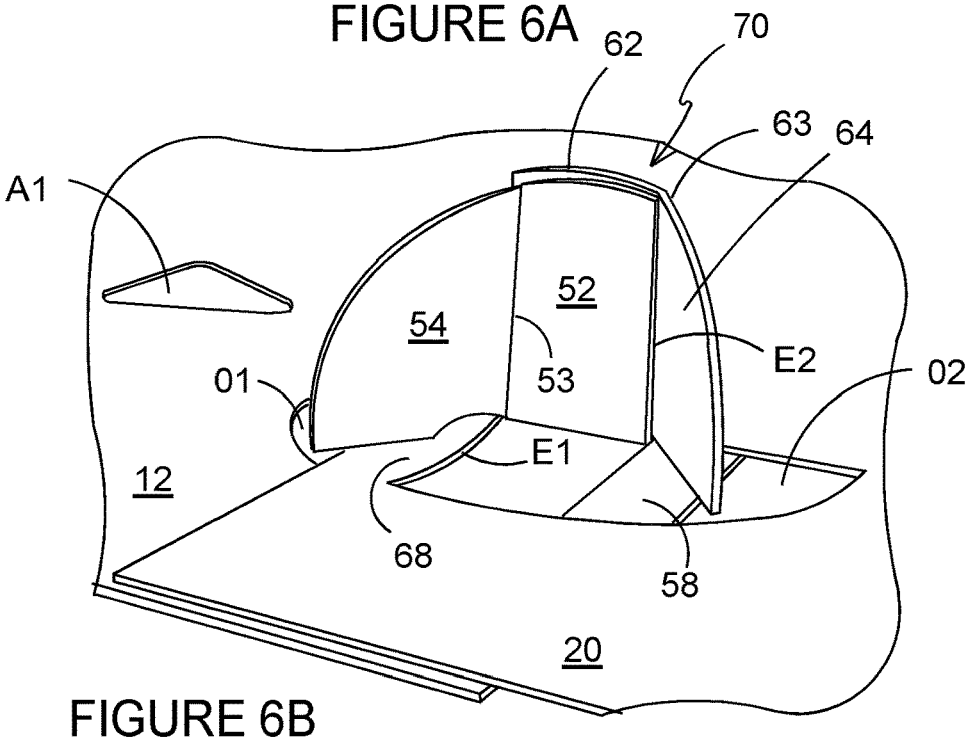
Figure 7:
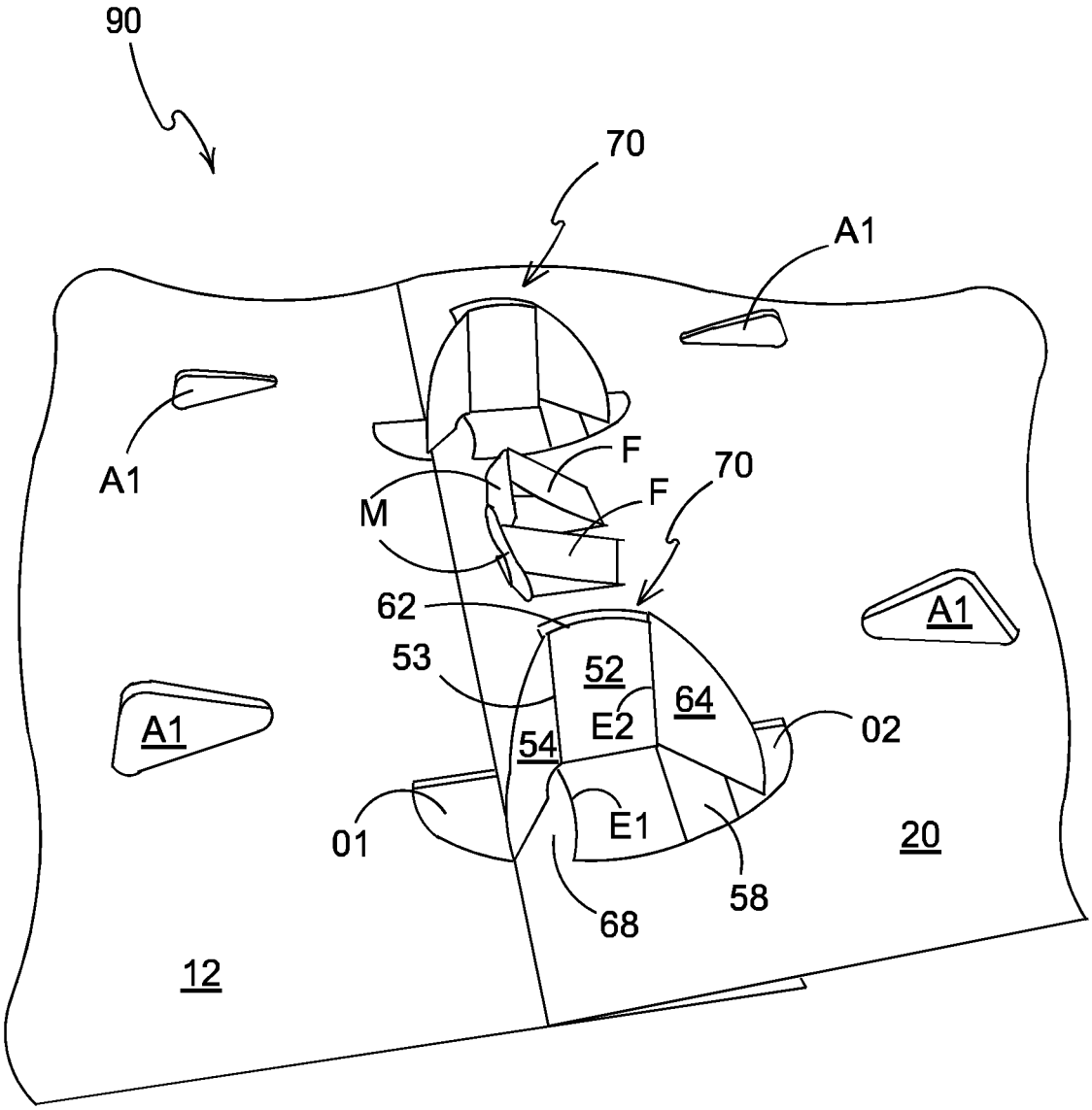
FIG. 7 is a perspective view of a first side of a keel structure disposed in an interior of the carton of FIG. 2.
Figure 8:
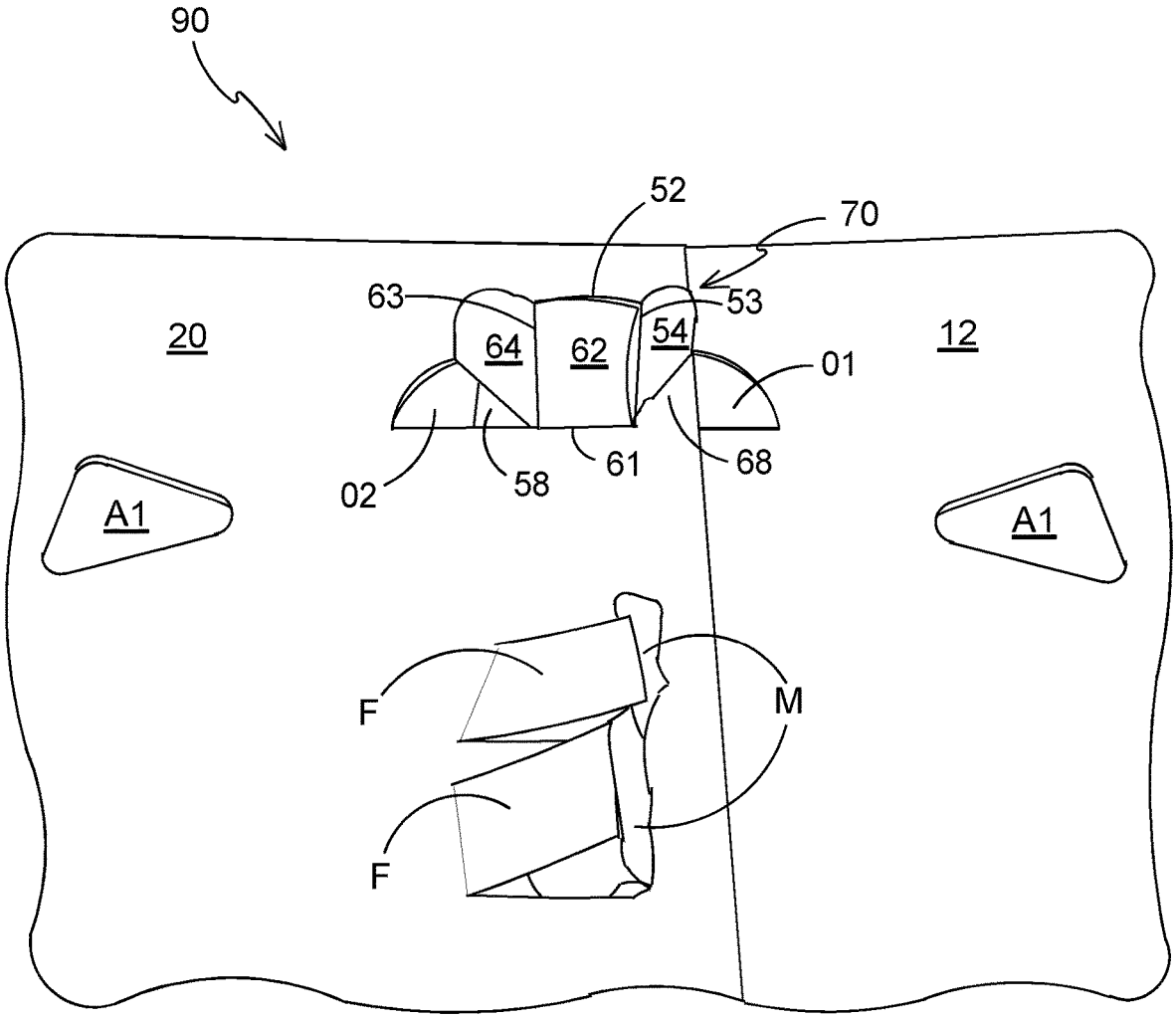
FIG. 8 is a perspective view of a second side of the keel structure of FIG. 7.

Each of the top engaging structures T comprises an opening O3 (see FIG. 2) defined by a cut line or severable line 30. The cut line 30 is struck from at least the second side panel 18. Optionally, the cut line 30 is curved or arcuate in shape. The cut line 30 interrupts the fold line 17 between the top panel 16 and the second side panel 18. A pair of further cut lines 32, 34 may extend radially outward from the cut line 30. When the second side panel 18 is folded with respect to the top panel 16, about fold line 17, the cut line 30 opens up to form the opening O3 which can receive a portion of an article B. In the illustrated embodiment the opening O3 receives a flange F of an article B, best illustrated in FIG. 5.

The cut lines 30 each define a protrusion extending from the side edges of the top panel 16 and integrally formed therewith. The protrusions are struck from material which would otherwise form the second side panel 18. In this way protrusions may be considered to be struck from one of the first and second side panels 14, 18. The protrusions each form a protective top cover for a portion of an article B which is received in the opening O3 formed by folding the side panels 14, 18, see FIG. 2.

Optionally, the top panel 16 may comprise a second aperture A2, the second aperture A2 may form a display window for displaying a portion of an article B disposed therebelow. The second aperture A2 may also may improve air flow or ventilation of the carton 90 for example when in cold storage.

The first and second side panels 14, 18 comprise optional third apertures A3, which may improve air flow or ventilation of the carton 90 for example when in cold storage.

The blank 10 comprises three keel structures 70 arranged in pairs and denoted generally by references signs 70, see FIGS. 6A to 8. The keel structures 70 are struck in part from the first base panel 12 and in part from the second base panel 20. Each of the keel structures 70 is formed from a first part 50 struck from the first base panel 12 and from a second part 60 struck from the second base panel 20. Each of the keel structures 70 is substantially similar in construction and will be described with reference to a keel structure 70 provided at a first end of the blank 10.

The first part 50 of the keel structure 70 comprises a first tab 52/54 which forms an outer member of the keel structure 70.

The first tab 52/54 is hingedly connected to the first base panel 12 by a fold line 51, the fold line 51 is arranged to extend transversely with respect to the tubular axis of the carton 90. The fold line 51 is arranged to extend substantially perpendicularly with respect to the fold line 13 hinging the first base panel 12 to the first side panel 14.

The first tab 52/54 is defined in part by the fold line 51 and in part by a cut line 55 or severable line provided in the first base panel 12. Together the fold line 51 and the cutline 55 define the outline of an opening O1 in the first base panel 12.

The first tab 52/54 comprises a first spine portion 52, the first spine portion 52 is hingedly connected to the first base panel 12 by the fold line 51. The first tab 52/54 further comprises a first wing portion (or first engaging portion) 54. The first wing portion 54 is hingedly connected to the first spine portion 52 by a fold line 53. The first wing portion 54 is defined in part by a cutline or severance line such that the first wing portion 54 is separable from the first base panel 12. The first wing portion 54 is coupled to the first base panel 12 by the first spine portion 52, in this way the first spine portion 52 interconnects the first wing portion 54 and the first base panel 12. The portion of the cutline 55 defining, in part, the first wing portion 54 comprises a cutaway or clearance recess 56 disposed proximate or adjacent to the fold line 51 hinging the first spine portion 52 to the first base panel 12. The first wing portion 54 forms a first engaging portion which engages or interacts with the second base panel 20 in an erected condition.

The second part 60 of the keel structure 70 comprises a second tab 62/64 which forms an inner member of the keel structure 70.

The second tab 62/64 is hingedly connected to the second base panel 20 by a fold line 61, the fold line 61 is arranged to extend transversely with respect to the tubular axis of the carton 90. The fold line 61 is arranged to extend substantially perpendicularly with respect to the fold line 19 hinging the second base panel 20 to the second side panel 18.

The second tab 62/64 is defined in part by the fold line 61 and in part by a cut line 65 or severable line provided in the second base panel 20. Together the fold line 61 and the cutline 65 define the outline of an opening O2 in the second base panel 20.

The second tab 62/64 comprises a second spine portion 62, the second spine portion 62 is hingedly connected to the second base panel 20 by the fold line 61. The second tab 62/64 comprises a second wing portion (or second engaging portion) 64. The second wing portion 64 is hingedly connected to the second spine portion 62 by a fold line 63. The second wing portion 64 is defined in part by a cutline or severance line such that the second wing portion 64 is separable from the second base panel 20. The second wing portion 64 is coupled to the second base panel 20 by the second spine portion 62, in this way the second spine portion 62 interconnects the second wing portion 64 and the second base panel 20.

The second spine portion 62 comprises a free side edge E3 (see FIG. 8) which is disposed opposite to the fold line 63 and adjacent to the fold line 61.

The free side edge E3 may be nonlinear or arcuate in shape such that the second spine portion 62 comprises a waist, narrower region in the middle.

The second wing portion 64 may be provided with a recess, proximate the fold line 61, similar to the recess 56.

The second wing portion 64 forms a second engaging portion which engages or interacts with the first base panel 12 in an erected condition.

Turning to the construction of the carton 90 as illustrated in FIG. 2, the carton 90 can be formed by a series of sequential folding operations in a straight-line machine so that the carton 90 is not required to be rotated or inverted to complete its construction. The folding process is not limited to that described below and may be altered according to particular manufacturing requirements.

A group of articles B is assembled; in the embodiment illustrated in FIG. 2 six articles B are arranged in a 2×3 array. The top panel 16 of the blank 10 is disposed above the group of articles B to provide a top wall 16 of the carton 90.

The first and second side walls 14, 18 are folded, with respect to the top panel 16 about fold lines 15, 17 respectively, about opposing sides of the group of articles B so as to be disposed about the opposing sides of the group of articles B. A flange or skirt F of each article B is received in a respective one of the openings O3 of the top engaging structures T created when first and second side walls 14, 18 are folded.

The first base panel 12 is folded about the fold line 13 so as to be disposed adjacent the base of the group of articles B. The second base panel 20 is then folded about the fold line 19 so as to be in at least partial overlapping relationship with the first base panel 12. The first and second base panels 12, 20 are secured together. Each of the male tabs M is displaced inwardly out of the plane of the second base panel 20. In so doing, each of the female tabs F is displaced inwardly creating a corresponding opening in the first base panel 12. The male tabs M are received in respective ones of the openings so as to lock the first and second base panels 12, 20 together. In this way a tubular structure is formed about the group of articles B.

Figure 4A:
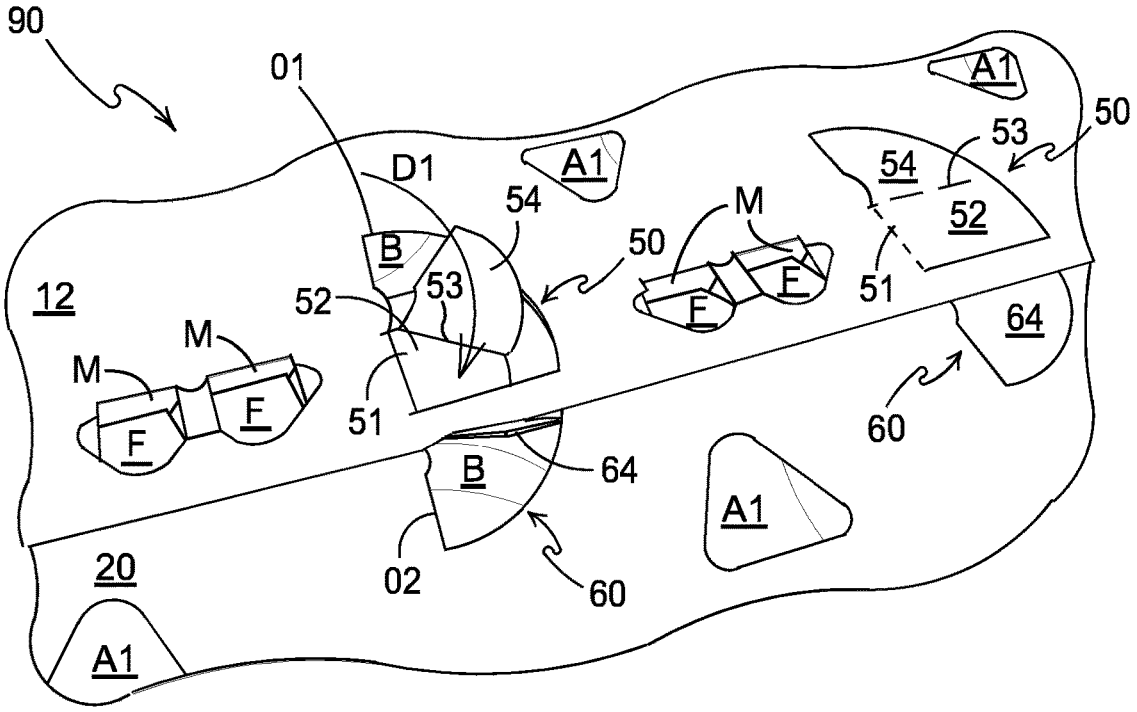
FIGS. 4A and 4B are perspective views from below of a base portion of the carton of FIG. 2 showing stages of construction of a keel structure.
Figure 4B:
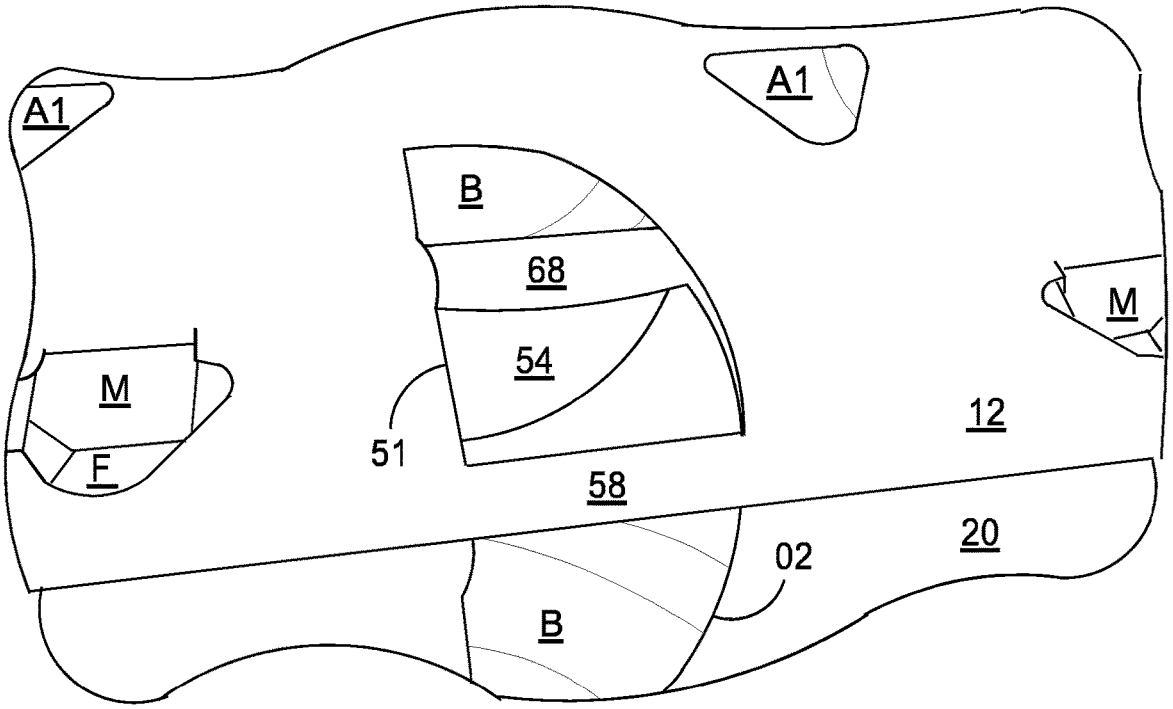

FIGS. 4A and 4B illustrates erection of one of the keel structures 70. A tool is engaged with the first spine portion 52, the first spine portion 52 is folded inwardly about fold line 51. In doing so the first wing portion 54 is automatically folded about fold line 53. A portion of the second base panel 20, which is in overlapping relationship with the first base panel 12 and is disposed proximate to the opening O2, provides a static folding guide 68 for facilitating folding of the first wing portion 54. The folding guide 68 comprises an edge E1. The folding guide 68 has the effect of limiting the size of the opening O1 in the composite base panel 12/20 through which the first tab 52/54 may pass. In order for the first tab 52/54 to pass through second base panel 20, the first wing portion 54 must fold with respect to the first spine portion 52, about the fold line 53 (FIG. 4A).

When the keel structures 70 are erected, the first base panel 12 comprises a first opening O1 while the second base panel 20 comprises a second opening O2. The first opening O1 is created by folding the first tab 52/54 out of the plane of the first base panel 12. The second opening O2 is created by folding the second tab 62/64 out of the plane of the second base panel 20. The first opening O1 and the second opening O2 are partially aligned in the vertical direction (or the direction of the thickness of the first and second base panels 12, 20). That is to say, the first and second openings O1, O2 partially overlap with each other.

When the first spine portion 52 is displaced inwardly, the second spine portion 62, which is in vertical alignment or registry with the first spine portion 52, is displaced inwardly also. The second wing portion 64 is folded with respect to the second spine portion 62 about fold line 63 in response to inward displacement of the second tab 62/64. The second wing portion 64 is folded automatically. The second wing portion 64 is folded in order to allow the second tab 62/64 to pass into a gap or void between two adjacently disposed articles B in the carton 90. An edge E2 of the first spine portion 52 provides a mandrel or folding guide for facilitating folding of the second wing portion 64. One of the two adjacently disposed articles B may interact with the second wing portion 64, encouraging the second wing portion 64 to fold with respect to the second spine portion 62. The article B may be considered to provide a static folding guide for folding the second tab 62/64.

FIGS. 6A to 8 illustrate the keel structure 70 in an assembled condition the portion of the second base panel 20 which provides the folding guide 68 provides an engaging surface which serves to retain the keel structure 70 in the erected form. The first wing portion 54, upon passing through the second opening O2 in the second base panel 20, at least partially unfolds with respect to the first spine portion 52, about fold line 53. The first wing portion 54 may naturally unfold due the inherent resilience of the sheet material from which the blank 10 is formed, alternatively the first wing portion 54 may be deliberately or intentionally unfolded during erection. In this way the first wing portion 54 engages with the folding guide 68 region of the second base panel 20. An edge of the first wing portion 54, which is collinear with the fold line 51 in the blank 10, forms an engaging edge which contacts the folding guide 68 region of the second base panel 20 so as to prevent or inhibit the first tab 52/54 from returning to an unfolded state.

The edge E1 of the folding guide 68 may be non-linear in shape, as illustrated in FIG. 1, the edge E1 may be arcuate or curvilinear. In other embodiments, the edge E1 may be formed of two or more linear section divergently arranged with respect each other.

In still other embodiments the edge E1 may be linear. In some embodiments the edge E1 may be non-parallel, or obliquely oriented, with respect to the free end edge of the second base panel such that the folding guide region 68 is wider at one end than it is at the other. For example, but not limited to, the folding guide region 68 may be narrower in the transverse direction at a first end proximate the fold line 51 than it is at second end distal from the fold line 51.

The edge E1 may be non-parallel or obliquely oriented with respect to the fold line 51 and/or with respect to the fold line 61.

The first spine portion 52 overlaps with the second spine portion 62, in this way the first spine portion 52 when held in the erected condition prevents or inhibits the second tab 62/64 from returning to an unfolded state.

The first spine portion 52 overlaps with the second spine portion 62 to provide a two-ply structure between the two adjacently disposed articles B, this may be advantageous, increasing strength, when the keel structure serves to function as a spacer or brace between the two adjacently disposed articles B to prevent or inhibit movement of the two adjacently disposed articles B.

The clearance recess 56 in the engaging edge of the first wing portion 54 facilitates erection of the first tab 52/54. It aids complete insertion of the first tab 52/54 particularly the first wing portion 54 into the opening O2 in the second base panel 20. The clearance recess 56 can receive at least a portion of the folding guide 68. The clearance recess 56 prevents or reduces the likelihood of collision of the engaging edge of the wing portion 54 with the edge E1 of the folding guide 68 in the region proximate the fold line 51. In this way allowance for the thickness of the sheet material of the folding guide 68 is made such that the wing portion 54 clears the folding guide 68.

A portion 58 of the first base panel 12 which overlaps with the second opening O2 so as to partially obscure or interrupt the second opening O2 may also serve to retain the keel structure 70 in the erected form. The second wing portion 64 is folded with respect to the second spine portion 62, about fold line 63 so as to at least partially overlie the portion 58. The second wing portion 64 may engage with the portion 58 of the first base panel 12. An edge of the second wing portion 64, which is collinear with the fold line 61 in the blank 10, forms an engaging edge which contacts the portion 58 of the first base panel 12 so as to prevent or inhibit the second tab 62/64 from returning to an unfolded state.

A free side edge E2 of the first spine panel 52 provides a mandrel or folding guide about which the second wing portion 64 folds with respect to the second spine portion 62. The free side edge E2 of the first spine panel 52 may be substantially aligned with the fold line 63 coupling the second wing portion 64 to the second spine portion 62.

Figure 3A:
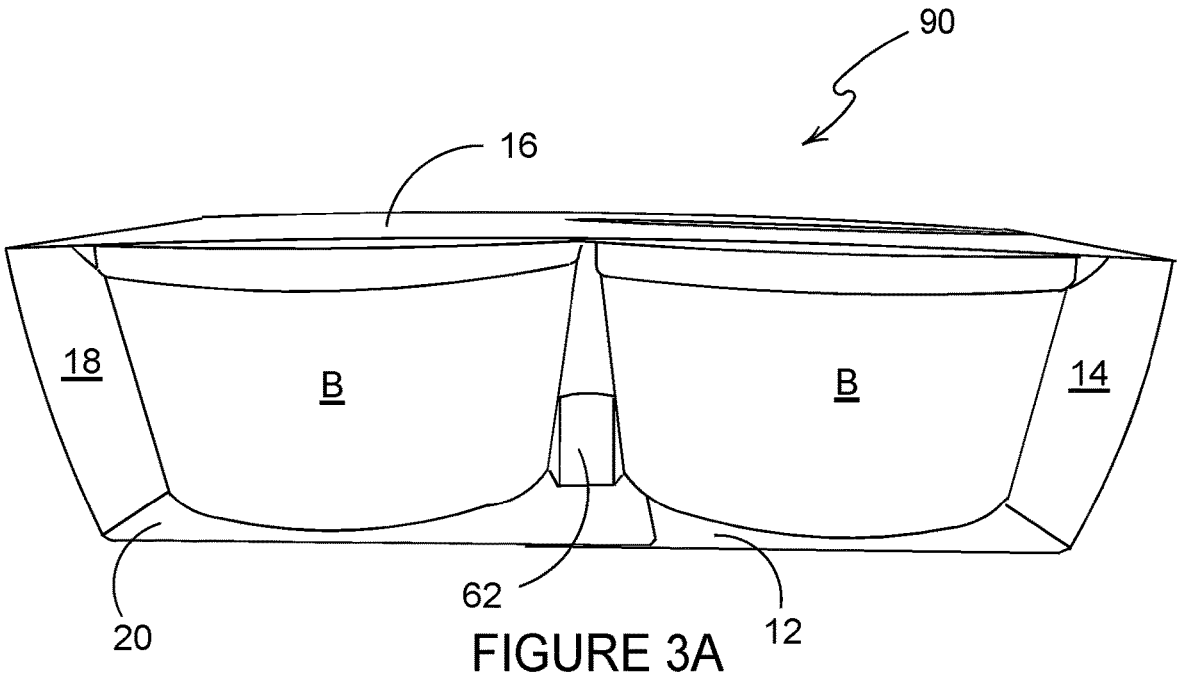
FIG. 3A is a perspective view of a first end of the carton of FIG. 2.
Figure 3B:
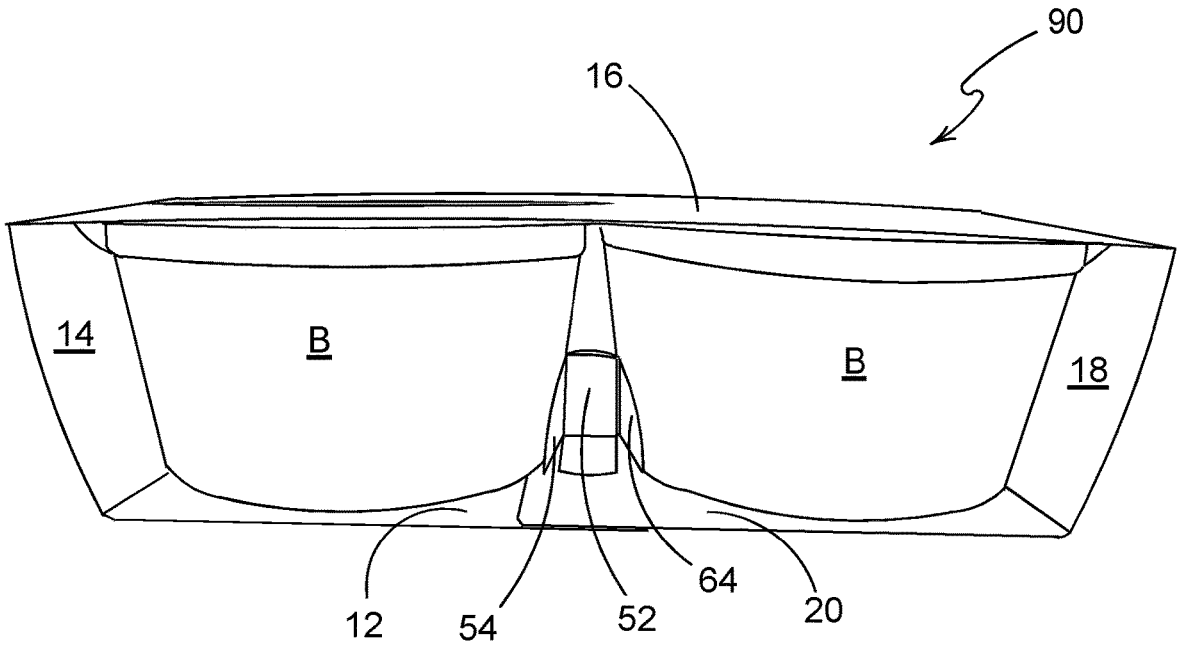
FIG. 3B is a perspective view of a second end of the carton of FIG. 2.

The assembled carton 90 is shown in FIGS. 2 to 3B. FIGS. 3A and 3B illustrate the carton 90, from a first end and a second end respectively.

The flange F of each article B has been at least partially received in the opening O3 of the top engaging structure T. In the illustrated embodiment the articles B are disconnected or individual cups which are disposed in close proximity to their adjacent neighbours. The articles B are tapered in shape, they can be considered to be substantially frusto-conical in shape, albeit inverted such that the end having the smaller diameter is in contact with the composite base panel 12/20 and the end having the larger diameter is in contact with the top panel 16.

A void or gap exists between lower portions of two adjacent articles B. A keel structure 70 is erected in the void between two adjacent articles B. Each keel structure 70 may serve to provide a spacer or brace.

The keel structures 70 may encourage the articles B towards one of the first and second side panels 14, 18 respectively. The keel structures 70 may push or force the articles B in a transverse direction. The transverse direction is perpendicular to the tubular axis of the carton 90 and is substantially parallel to the composite base panel 12/20.

The keel structures 70 may prevent or inhibit movement of the articles B towards each other, in particular the lower ends or base portions of the articles B.

In this way the keel structures 70 may be advantageous in maintaining secure engagement of the articles with their respective top engaging structure T. This may ensure the articles B are securely held within the carton 90 during transportation.

The present disclosure provides a carton 90 for packaging articles B. The carton may comprise a top engaging device T for flanged articles, such as flanged cups. The cups may be disconnected or may connected to each other via their respective flanges. The carton 90 comprises a composite wall 12/20 formed from two at least partially overlapping layers of sheet material and including an inner layer 20 and an outer layer 12. The carton 90 comprises a plurality of panels forming walls of a tubular structure which may include a top wall 18, a first side wall 14, a base wall 12/20, and a second side wall 18, optionally hingedly connected to each other in a linear series.

The carton 90 may comprise a keel structure 70 for placement between two adjacent articles B to be packaged in the carton 90 which may provide a spacer between said articles B.

The carton 90 may comprise a keel structure 70 folded into an interior of the carton 90, the keel structure 70 formed in part from the inner layer 20 of a composite wall 12/20 and in part from the outer layer 12 of a composite wall 12/20. The keel structure 70 interlocks the inner and outer layers 20, 12 together.

The carton 90 may comprise a keel structure 70 having an inner member 60 formed from the inner layer 20 and an outer member 50 formed from the outer layer 12. The inner and outer members 60, 50 are hingedly connected to the inner and outer layers 20, 12 along inner and outer fold lines 61, 51 respectively. The inner and outer fold lines 61, 51 are generally aligned in the direction of the thickness of the inner and outer layers 20, 12. The inner and outer members 60, 50 are disposed in an overlapping relationship such that at least part E2 of the free outline of the outer member 50, the free outline is defined by a cutline 55 which defines in part the outer member 50, said part E2 provides a folding guide or mandrel to the inner member 60 to facilitate an engaging portion 64 of the inner member 60 to fold about the at least part E2 of the free outline 55 when the outer member 50 is folded inward of the carton 90 along the outer fold line 51 against the inner member 60.

The carton 90 may comprise a keel structure 70 hingedly connected to the base wall 12/20 and folded into an interior of the carton 90. The keel structure 70 may comprise an outer member 50 in the form of a first tab 52/54. The keel structure 70 may comprise an inner member 60 in the form of a second tab 62/64.

The carton 90 may comprise a keel structure 70 or spacer device comprising an inner member 60 or second tab 62/64 formed from the inner layer 20 and an access opening O1 defined in the outer layer 12. The access opening O1 may be defined by the outer member 50 or first tab 52/54. The inner member 60 is hingedly connected to the inner layer 20. The inner member 60 is disposed in an overlapping relationship with the access opening O1 so that the inner member 60 is accessible through the access opening O1 to enable the inner member 60 to be folded inwardly of the carton 90. The inner member 60 may only partially overlap with the access opening O1.

The respective footprints—the space occupied in the respective one of the inner or outer layers 20, 12—of the inner member 60 and of the access opening O1 may be different in size, for example the access opening O1 may comprise a smaller linear dimension or area than the inner member 60.

The inner member 60 may comprise an engaging portion 64 foldable with respect to a spine or hinged portion 62, the hinged portion 62 being hingedly connected to the inner layer 20. The engaging portion 64 may comprise an engaging edge which engages with an engaging portion 58 of the outer layer 12 to prevent or inhibit the inner member 60 returning to an unfolded condition. The engaging portion 58 of the outer layer 12 is disposed in overlapping relationship with an opening O2 in the inner layer 20 created by folding the inner member 60 inwardly of the carton 90.

It can be appreciated that various changes may be made within the scope of the present invention. For example, the size and shape of the panels and apertures may be adjusted to accommodate articles of differing size or shape.

It will be recognised that as used herein, directional references such as "top", "bottom", "base", "front", "back", "end", "side", "inner", "outer", "upper" and "lower" do not necessarily limit the respective panels to such orientation, but may merely serve to distinguish these panels from one another.

As used herein, the terms "hinged connection" and "fold line" refer to all manner of lines that define hinge features of the blank, facilitate folding portions of the blank with respect to one another, or otherwise indicate optimal panel folding locations for the blank. Any reference to "hinged connection" should not be construed as necessarily referring to a single fold line only; indeed, a hinged connection can be formed from two or more fold lines wherein each of the two or more fold lines may be either straight/linear or curved/curvilinear in shape. When linear fold lines form a hinged connection, they may be disposed parallel with each other or be slightly angled with respect to each other. When curvilinear fold lines form a hinged connection, they may intersect each other to define a shaped panel within the area surrounded by the curvilinear fold lines. A typical example of such a hinged connection may comprise a pair of arched or arcuate fold lines intersecting at two points such that they define an elliptical panel therebetween. A hinged connection may be formed from one or more linear fold lines and one or more curvilinear fold lines. A typical example of such a hinged connection may comprise a combination of a linear fold line and an arched or arcuate fold line which intersect at two points such that they define a half moon-shaped panel therebetween.

As used herein, the term "fold line" may refer to one of the following: a scored line, an embossed line, a debossed line, a line of perforations, a line of short slits, a line of half-cuts, a single half-cut, an interrupted cutline, a line of aligned slits, a line of scores and any combination of the aforesaid options.

It should be understood that hinged connections and fold lines can each include elements that are formed in the substrate of the blank including perforations, a line of perforations, a line of short slits, a line of half-cuts, a single half-cut, a cutline, an interrupted cutline, slits, scores, any combination thereof, and the like. The elements can be dimensioned and arranged to provide the desired functionality. For example, a line of perforations can be dimensioned or designed with degrees of weakness to define a fold line and/or a severance line. The line of perforations can be designed to facilitate folding and resist breaking, to facilitate folding and facilitate breaking with more effort, or to facilitate breaking with little effort.

The phrase "in registry with" as used herein refers to the alignment of two or more elements in an erected carton, such as an aperture formed in a first of two overlapping panels and a second aperture formed in a second of two overlapping panels. Those elements in registry with each other may be aligned with each other in the direction of the thickness of the overlapping panels. For example, when an aperture in a first panel is "in registry with" a second aperture in a second panel that is placed in an overlapping arrangement with the first panel, an edge of the aperture may extend along at least a portion of an edge of the second aperture and may be aligned, in the direction of the thickness of the first and second panels, with the second aperture.

The invention claimed is:

1. An article carrier for packaging a plurality of articles, the carrier comprising a composite wall formed from two at least partially overlapping layers of sheet material and including an inner layer and an outer layer, the carrier further comprising a keel structure folded into an interior of the carrier, the keel structure having an inner member formed from the inner layer and an outer member formed from the outer layer, the inner and outer members being hingedly connected to a respective one of the inner and outer layers along inner and outer fold lines respectively, the inner and outer fold lines being generally aligned, the inner and outer members being disposed in an overlapping relationship such that at least part of a free outline of the outer member provides a folding guide to the inner member, the inner member comprises a spine fold line and an engaging portion connected to the spine fold line, the folding guide facilitates folding of the engaging portion of the inner member along the spine fold line when the outer member is folded inward of the carrier along the outer fold line against the inner member.

2. An article carrier according to claim 1, wherein the keel structure is configured to be disposed between two adjacent articles packaged in the carrier and provides a spacer between said articles.

3. An article carrier according to claim 1, wherein the keel structure interlocks the inner and outer layers of the composite wall together.

4. An article carrier according to claim 1, wherein the outer member comprises a first tab, and wherein the inner member comprises a second tab.

5. An article carrier according to claim 1, wherein the outer member comprises an engaging edge and wherein a recess is provided in the engaging edge proximate to the outer fold line.

6. An article carrier according to claim 1, wherein the inner member defines at least in part an inner opening, the inner opening defining at least in part an edge of an engaging region of the inner layer.

7. An article carrier according to claim 6, wherein the edge of the engaging region is at least one of the following: non-linear, arcuate, non-perpendicular with the outer fold line, and obliquely oriented with respect to the outer fold line.

8. An article carrier according to claim 1, further comprising a top engaging device for engaging each article to be packaged, each top engaging device comprising an opening for receiving a portion of an article.

9. An article carrier according to claim 8, wherein a plurality of top engaging devices respectively engage a plurality of individual, disconnected articles.

10. An article carrier according to claim 8, wherein a plurality of top engaging devices respectively engage a plurality of connected articles.

11. An article carrier according to claim 10, wherein each article comprises a flange and the articles are connected to each other via their respective flanges.

12. An article carrier according to claim 1, further comprising a plurality of panels forming walls of a tubular structure, the walls comprising a top wall, a first side wall, a composite base wall comprising the inner and outer layers, and a second side wall.

13. An article carrier according to claim 12, wherein the plurality of panels are hingedly connected to each other in a linear series.

14. An article carrier for packaging a plurality of articles, the carrier comprising a composite wall formed from two at least partially overlapping layers of sheet material and including an inner layer and an outer layer, the carrier further comprising a keel structure folded into an interior of the carrier, the keel structure having an inner member formed from the inner layer and an outer member formed from the outer layer, the inner and outer members being hingedly connected to a respective one of the inner and outer layers along inner and outer fold lines respectively, the inner and outer fold lines being generally aligned in a direction of thickness of the inner and outer layers, the inner and outer members being disposed in an overlapping relationship such that at least part of a free outline of the outer member provides a folding guide to the inner member, the folding guide facilitates folding of an engaging portion of the inner member when the outer member is folded inward of the carrier along the outer fold line against the inner member, wherein the outer member comprises a first tab, and wherein the inner member comprises a second tab, and wherein the first tab comprises a first spine portion and a first engaging portion hingedly connected to the first spine portion, and wherein the second tab comprises a second spine portion and a second engaging portion hingedly connected to the second spine portion.

15. An article carrier according claim 14, wherein the first spine portion overlaps with the second spine portion to form a two-ply structure.

16. An article carrier, comprising:

a composite wall formed from two at least partially overlapping layers of sheet material and including an inner layer and an outer layer;

a spacer device folded into an interior of the carrier and configured to be disposed at a position between two adjacent articles to be held by the article carrier so as to prevent or inhibit movement of the two adjacent articles, the spacer device comprising:

an inner member formed from the inner layer and hingedly connected to the inner layer, the inner member being disposed in an at least partially overlapping relationship with an access opening defined in the outer layer by an outer member formed from the outer layer so that the inner member is accessible through the access opening, wherein the inner member comprises an engaging portion comprising an engaging edge which engages with an engaging portion of the outer layer separate from the outer member to prevent or inhibit the inner member from returning to an unfolded condition.

17. An article carrier according to claim 16, wherein the engaging portion of the inner member is foldably connected to a hinged portion, the hinged portion being hinged to the inner layer.

18. An article carrier according to claim 17, wherein the engaging portion of the outer layer is disposed in overlapping relationship with an opening in the inner layer created by folding the inner member inwardly of the carrier.

19. A blank for forming a carrier, the blank comprising a plurality of panels for forming walls of the carrier, the plurality of panels comprising a first panel and a second panel for forming an inner layer and outer layer respectively of a composite wall of the carrier, the blank further comprising a keel structure foldable into an interior of a set-up carrier, the keel structure having an inner member formed from the first panel and an outer member formed from the second panel, the inner and outer members being hingedly connected to a respective one of the first and second panels along inner and outer fold lines respectively, the inner and outer fold lines being arranged to be generally aligned in direction of thickness of the inner and outer layers in a set-up carrier and wherein the inner and outer members are shaped to be complementary such that at least part of a free outline of the outer member provides a folding guide to the inner member, the inner member comprises a spine fold line and an engaging portion connected to the spine fold line, the folding guide facilitates folding of the engaging portion of the inner member along the spine fold line when the outer member is folded inward of the carrier along the outer fold line against the inner member in an at least partially overlapping relationship.

* * * * *